US007628736B2

(12) United States Patent
Vandyke

(10) Patent No.: US 7,628,736 B2
(45) Date of Patent: Dec. 8, 2009

(54) MUSCLE EXERCISE DEVICE

(76) Inventor: David Vandyke, 109 Old Fort Road, Shoreham-By-Sea, West Sussex BN43 5HB (GB)

( * ) Notice: Subject to any disclaimer, the term of this patent is extended or adjusted under 35 U.S.C. 154(b) by 694 days.

(21) Appl. No.: 11/026,121

(22) Filed: Jan. 3, 2005

(65) Prior Publication Data

US 2005/0164852 A1 Jul. 28, 2005

(51) Int. Cl.
*A63B 21/00* (2006.01)

(52) U.S. Cl. ..... 482/93; 482/98; 482/99

(58) Field of Classification Search ..... 482/98–104, 482/126, 127, 94, 133, 49, 44, 45, 93
See application file for complete search history.

(56) References Cited

U.S. PATENT DOCUMENTS 2,456,412 A * 12/1948 Heimbaugh ..... 482/96
3,640,527 A * 2/1972 Proctor ..... 482/100
4,258,913 A * 3/1981 Brentham ..... 482/45
4,373,717 A * 2/1983 Lambert, Jr. ..... 482/45
4,629,185 A * 12/1986 Amann ..... 482/113
4,811,944 A * 3/1989 Hoff ..... 482/94
4,817,943 A * 4/1989 Pipasik ..... 482/97
5,413,546 A 5/1995 Basile ..... 482/99
5,788,607 A * 8/1998 Baker ..... 482/44
5,893,818 A * 4/1999 Zahiri et al. ..... 482/10

* cited by examiner

*Primary Examiner*—Jerome Donnelly
(74) *Attorney, Agent, or Firm*—Levy & Grandinetti

(57) ABSTRACT

A muscle exercise device comprising a hand grip, support means and resistance means, in which the hand grip has a longitudinal axis and is adapted to rotate on a rotation axis substantially half way along the longitudinal axis and normal to it, in which the support means rotatably carries the hand grip, and in which the resistance means acts against rotation of the hand grip on the rotation axis in at least one direction.

10 Claims, 3 Drawing Sheets

24
23
25
22
21
26
20
3
4
B
B
2
1
36
8
9
33
10
6
35
7
11

20
21
18
24
27
29
30
17
19
1
9
32
28
14
14
31
31
8
15
16
5
12
13

3
38
37
B
A
A
2
B

MUSCLE EXERCISE DEVICE

I claim the benefit under Title 35, United States Code, § 120 to British Patent Application Number 0400693.8, filed 13 Jan. 2004, entitled MUSCLE EXERCISE DEVICE.

This invention relates to a muscle exercise device for use particularly, but not exclusively, to supinate the forearm.

Muscles are exercised in order to improve strength or stamina for sport, or to condition them to improve cosmetic appearance. One of the most popular muscles to work on is the bicep at the front of the upper arm, whether for sport or looks.

However, current exercise machines and equipment do not provide the facility to exercise the bicep efficiently. The chief function of the bicep is to supinate the pronated forearm, and it only functions as a reserve muscle for elbow flexion. In other words, the bicep's primary function is to twist the wrist and turn the palms of the hands upwards. However, biceps are commonly exercised by means of elbow flexion, in other words the bringing of the hand towards the shoulder, when in actual fact it is the brachialis muscle behind the bicep which provides most of this movement.

It is known to use a dumbbell to perform an elbow flexion exercise, which involves lifting the dumbbell from adjacent the waist up to the shoulder. This exercise can involve forearm supination if the dumbbell is turned during the exercise.

However, an effective forearm supination exercise is not possible with a dumbbell, because the weights are carried on each side of the hand, and during the exercise the uppermost weight overbalances the dumbbell and assists the supination movement.

In addition, at the start of the above described elbow flexion exercise, a dumbbell can only conveniently be held sideways, with the forearm already half supinated, otherwise one side of the dumbbell hits the user's leg.

Further, as the weight is lifted up, the resistance is greater in the middle of the movement with the forearm extending outwards, and is less at the start and the finish.

The present invention is intended to overcome some of the above problems.

Therefore, according to the present invention a muscle exercise device comprises a hand grip, support means and resistance means, in which the hand grip has a longitudinal axis and is adapted to rotate on a rotation axis substantially half way along the longitudinal axis and normal to it, in which the support means rotatably carries the hand grip, and in which the resistance means acts against rotation of the hand grip on the rotation axis in at least one direction.

The resistance means can be weights which are mounted on a substantially vertical rack, such that they need to be lifted against the force of gravity.

Preferably the rotation axis of the hand grip can be substantially horizontal, and rotation of the hand grip on the rotation axis can be translated into substantially vertical lifting of said weights.

In one construction a winch drum can be mounted above the substantially vertical rack, and can be rotated by the hand grip. Further, a lifting band can extend from the drum and be connected to the weights, such that rotation of the winch drum winds the lifting band onto the winch drum and lifts the weights.

A ratchet device can be incorporated into the winch drum, such that rotation of the hand grip in a first direction turns the drum and lifts the weights, and rotation of the hand grip in the opposite direction does not turn the drum.

Preferably the hand grip can be disposed with the longitudinal axis parallel with the ground at the start, such that a user can grip the hand grip with their palm facing down, and then turn the hand grip through approximately 180 degrees to bring their palm uppermost and perform one supination action of the forearm. The hand grip can then be rotated back through 180 degrees in the opposite direction without the resistance of the weights applied.

It will be appreciated that these actions will result in the weights being lifted up in small increments during use, until they reach a top of the stack. Therefore, a mechanism can be provided for lowering the weights back down again. The ratchet can be released by any appropriate mechanism, and the weights can be lowered using a lowering handle attached to the drum. The lowering handle can be of sufficient dimensions to allow safe lowering of the weights by hand.

Alternatively, the ratchet can be reversible and the weights can be lowered in a reverse of the above described exercise action.

In a preferred construction the device can further comprise a frame, which comprises said vertical rack and said weights, and which carries the winch drum. In addition, the support means can comprise one portion of the frame.

The device can be provided with two hand grips, two support means, and two resistance means, one set for each hand. The two winch drums can turn in opposite directions, because supination of the forearm involves clockwise rotation of the right hand and ant-clockwise rotation of the left hand.

Therefore, the frame can carry both the hand grips and their associated parts. In addition the hand grips can be laterally spaced apart approximately the width of an average user's shoulders.

In addition, the distance between the two winch drums can be adjustable to accommodate users with different shoulder sizes. In a preferred construction the frame can comprise a beam mounted over the two weight stacks, and on which the winch drums are mounted. The position of the winch drums on the beam can be adjusted by means of a series of slots and an associated pin. The lifting band can be threaded through a slot disposed above the weight stack, such that if a winch drum is positioned away from the weight stack, the lifting band extends vertically from the weights, through the slot, and at an angle to the winch drum.

The frame can also comprise a seat, which is disposed in front of the hand grips, such that a user can readily grip the hand grips when seated on the seat. It will be appreciated that users may vary in size, so the seat can be provided with vertical adjustment means, and can be elongate in shape so the user can position themselves the correct distance from the hand grips.

The seat can be positioned such that in use, the user's arms are bent at the elbow approximately 90 degrees. This provides the optimum position to exercise the biceps.

The invention can be performed in various ways but one embodiment will now be described by way of example and with reference to the accompanying drawings, in which.

Figure 1:
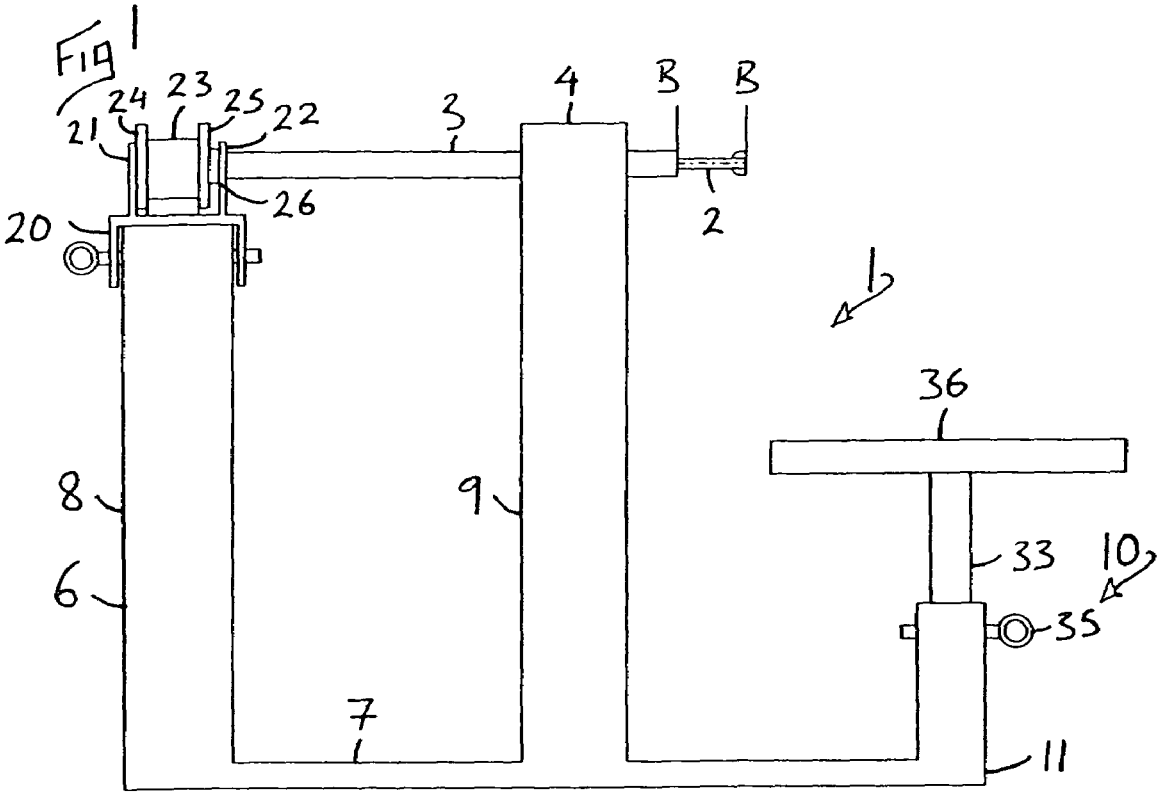
FIG. 1 is a side view of a muscle exercise device according to the present invention.

As shown in the Figures, a muscle exercise device 1 comprises hand grips 2, support means in the form of rods 3 and frame beam 4, and resistance means in the form of weights 5. The hand grips 2 have a longitudinal axis A-A (best shown in FIG. 5) and are adapted to rotate on a rotation axis B-B (best shown in FIG. 5) substantially half way along the longitudinal axis A-A and normal to it, in which the rods 3 rotatably carry the hand grips 2, and in which the weights 5 act against rotation of the hand grips 2 on the rotation axis B-B in at least one direction.

The device 1 generally comprises a frame 6 comprising a rectangular base section 7, a first upright frame section 8 and second upright frame section 9. Seat 10 extends at the rear 11 of the base section 7.

Two vertical weight stacks 12 and 13 are disposed under first upright frame section 8, and both comprise guide posts 14 and individual weight units 15. The stacks 12 and 13 function in the conventional manner and in use the units 15 above the unit with pin 16 slotted under it can be lifted.

Mounted on beam 17 of the first upright frame section 8 are winch units 18 and 19. Both winch units 18 and 19 comprise a U-shaped base 20 which is seated on the beam 17 and has drum mounting uprights 21 and 22. A drum 23 is mounted on an axle (not visible) mounted between the uprights 21 and 22, and is provided with rim flanges 24 and 25. The rod 3 is connected to the drum 23 via ratchet mechanism 26. (Ratchet mechanism 26 is of a conventional arrangement and therefore further detail is not shown here. It generally comprises an annular cog and a locking member which can engage teeth on the cog. The locking member and the shape of the teeth allow the drum 23 to rotate in one direction only, unless the locking member is retracted against a spring which allows the cog to rotate freely.)

The ratchet mechanism 26 of winch unit 18 allows its drum 23 to be rotated in a clockwise direction, while the ratchet mechanism 26 of winch unit 19 allows its drum 23 to be rotated in an anti-clockwise direction.

To lower lifted weights back down onto the weight stacks 12 and 13 the ratchet mechanisms 26 are released and a lowering handle (not shown) is applied to the drum 23 by means of slot 27. The user can then safely lower the lifted weights by rotating the handle.

The beam 17 is provided with two rows of slots 28, which co-operate with slot 29 on the base 20 and pin 30, and allow the winch units 18 and 19 to be spaced apart different amounts to suit the shoulder dimensions of the user.

Bands 31 extends from the weights 5 to the drums 23, and in use the bands 31 are wound around the drums 23 as the weights 5 are lifted. The bands 31 extend through slots (not visible) in the beam 17 directly above the weights 5. As a result when the winch units 18 and 19 are moved, the bands 31 still extend vertically from the weights, as shown clearly in FIG. 4.

Figure 2:
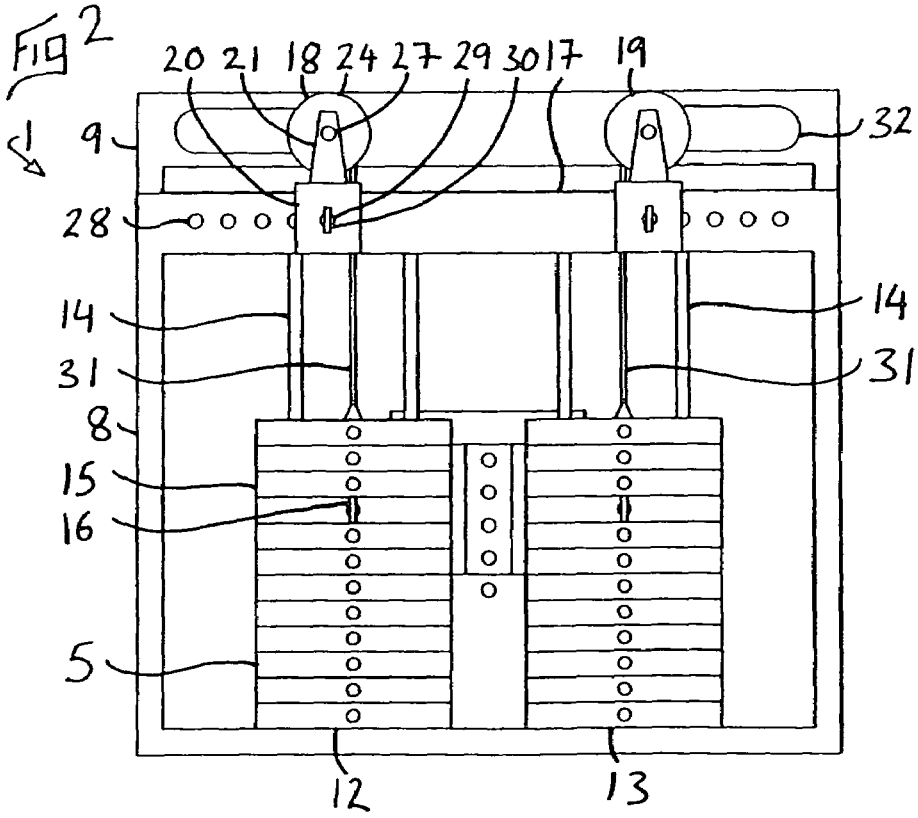
FIG. 2 is a front view of the muscle exercise device as shown in FIG. 1.
Figure 3:
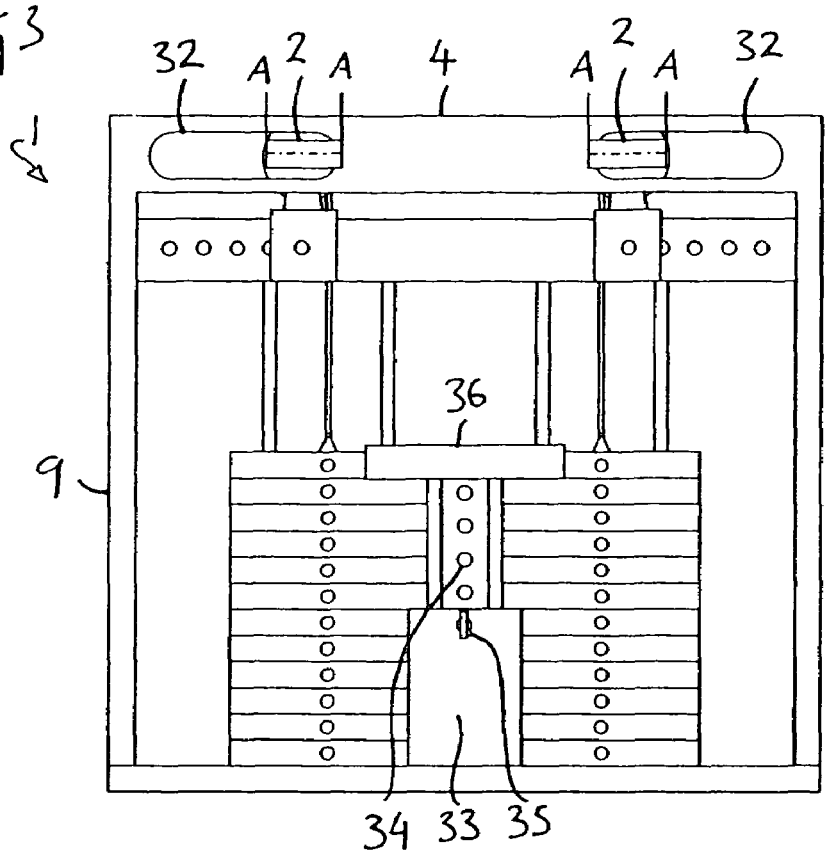
FIG. 3 is a rear view of the muscle exercise device as shown in FIG. 1.
Figure 4:
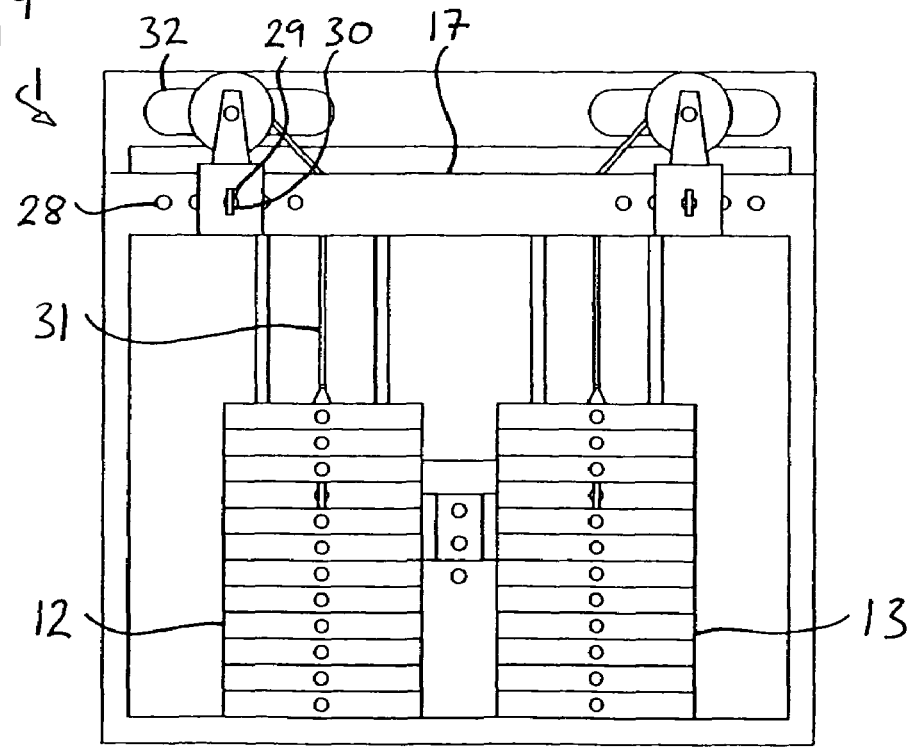
FIG. 4 is a front view of the muscle exercise device as shown in FIG. 1, in a second arrangement; and, FIG. 5 is a top view of a hand grip of the muscle exercise device as shown in FIG. 1.

In the arrangement shown in FIGS. 1 to 3, a portion of the bands 31 is wound around the drums 23, such that when the winch units 18 and 19 are moved laterally on the beam 17 (as shown in FIG. 4) the bands 31 can unwind and allow the winch units 18 and 19 to move.

Second upright frame section 9 comprises beam 4, through which rods 3 pass, and which supports rods 3. Slots 32 are provided in the beam 4 to allow the rods 3 to be moved laterally with the winch units 18 and 19 to which they are attached.

The seat 10 comprises a leg 33 which is adjustable by means of slots 34 and pin 35, and a platform 36, which allows the user to position the platform 36 at the correct height to reach the hand grips 2. The platform 36 is elongate in the same direction as the rotation axis B-B, which allows the user to position themselves a comfortable distance from the hand grips 2.

Figure 5:
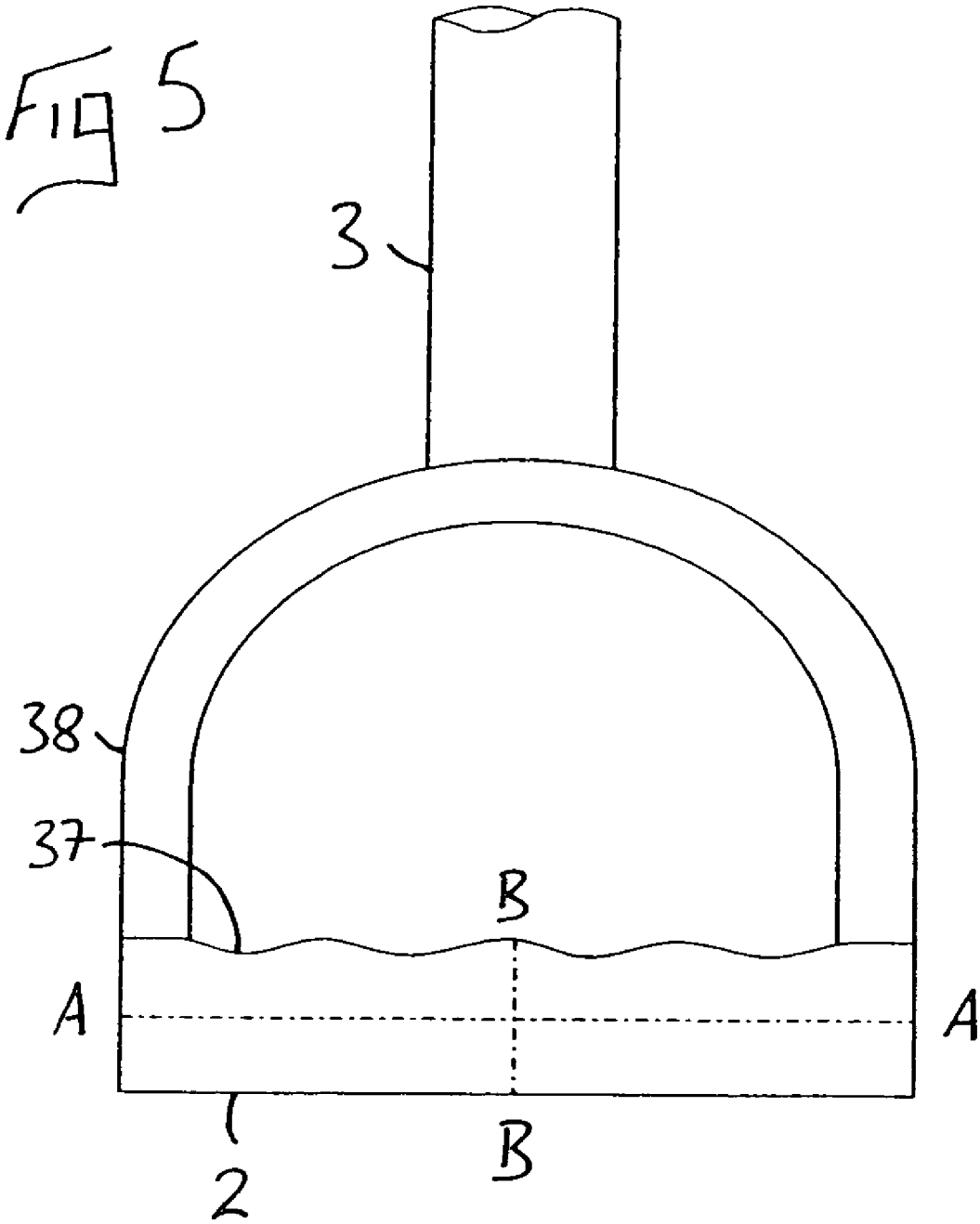

As shown in FIG. 5, the hand grips 2 comprise are generally stirrup shaped, and gripping portion 37 and a loop portion 38. The gripping portion 37 is shaped to receive a gripping hand, and loop portion 38 is connected to rod 3.

Therefore, in use a user adjusts the height of the seat 10 such that the hand grips 2 can be gripped with the arm folded at approximately 90 degrees at the elbow. In addition, the user can space apart winch units 18 and 19 on the beam 17 so they correspond to the approximate width of the user's shoulders, such that when the user grips the hand grips 2 their arms extend substantially forward from their body. The user also places pins 16 at the desired place on the weight stacks 12 and 13 for the exercise they wish to perform.

The user grips the hand grips 2 with the palms of their hands facing downwards, and then rotates the hand grips 2 through approximately 180 degrees with each hand to perform one supination action. The user's right hand turns in a clockwise direction and the user's left hand turns in an anti-clockwise direction. This action is allowed by the ratchet mechanisms 26 in the winch units 18 and 19. As a result the chosen weights 5 are lifted a small distance.

Then the user rotates their hands back through approximately 180 degrees in the opposite direction. The ratchet mechanisms 26 hold the weights 5 and the hand grips 2 can be rotated in this direction freely. This allows the user to return to the start of the exercise without performing a potentially damaging movement.

The above procedure is repeated until the user's biceps have been sufficiently worked, or the weights 5 have reached the top of the stacks 12 or 13 and contact the beam 17.

The weights 5 can then be lowered by releasing the ratchet mechanisms 26, and taking the strain with a lowering handle (not shown) which can be attached to the front of the drums 23 as described above.

It will be appreciated that the device 1 can be altered without departing from the spirit of the invention. For example, instead of weights a pneumatic or hydraulic ram could provide the resistance. Alternatively, the device could be wall-mounted rather than free standing. Further, the two stacks of weights could be replaced with one stack of weights to which both bands are attached.

Thus an exercise machine is provided which safely and correctly exercises the biceps by allowing complete supination of the forearm against a consistent resistance. Further, a device is provided with allows users of different heights and shoulder dimensions to exercise their biceps.

The invention claimed is:

1. A muscle exercise device comprising two elongated hand grips, one hand grip for each hand of a user, support means and resistance means, in which each hand grip has a longitudinal axis in which the support means rotatably carries the hand grip such that the hand grip is rotatable on a rotation axis which is normal to the longitudinal axis, and which intersects the longitudinal axis at a point which is substantially half way along the longitudinal axis, in which the resistance means acts against rotation of each hand grip on the rotation axis in one direction only and the resistance means comprises weights mounted on a substantially vertical rack, in which each hand grip is connected to a winch drum which is mourned above the substantially vertical rack, and the winch drum can be rotated by the hand grip, and a lifting band extends from the winch drum to the weights, such that rotation of the winch drum winds the lifting bands onto the winch drum and lifts the weights, and in which a ratchet means is provided between each hand grip and the winch drum to which it is connected and the ratchet means is adapted to allow rotation of the winch drum by the hand grip in only one direction and prevent the winch drum from rotating in the opposite direction.

2. A muscle exercise device as claimed in claim 1, in which the rotation axis of each hand grip is substantially horizontal, and rotation of each hand grip on the rotation axis is translated into substantially vertical lifting of said weights.

3. A muscle exercise device as claimed in claim 2 in which the lateral spacing between the hand grips can be adjusted.

4. A muscle exercise device as claimed in claim 3 in which each winch drum is mounted on a beam, and the position of each winch drum can be adjusted on the beam.

5. A muscle exercise device as claimed in claim 4 in which one hand grip is adapted for use with the left hand, and the other hand grip is adapted for use with the right hand, and in which the ratchet means associated with the left hand is adapted to allow the winch drum with which it is associated to be rotated in an anti-clockwise direction, in use, and in which the ratchet means associated with the right hand is adapted to allow the winch drum with which it is associated to be rotated in a clockwise direction, in use.

6. A muscle exercise device as claimed in claim 5 in which both hand grips are disposed with the longitudinal axis parallel with the ground, such that a user can grip each hand grip with their palm facing down, and then turn each hand grip through approximately 180 degrees to bring their palm uppermost and perform one supination action of the forearm.

7. A muscle exercise device as claimed in claim 6 in which both ratchet means are releasable such that the weights can be lowered after use.

8. A muscle exercise device as claimed in claim 7 in which the device comprises a frame comprising a rectangular base, a first rectangular upright frame portion and a second rectangular upright frame portion spaced apart from the first rectangular upright frame portion, in which said weights are disposed under the first rectangular upright frame portion, in which rods extend from the winch drums and though the second rectangular upright frame portion, and in which the hand grips are connected to the ends of the rods, and in which a seat is provided adjacent the second rectangular upright frame portion upon which a user can sit and grip the hand grips.

9. A muscle exercise device as claimed in claim 8 in which the height of the seat is adjustable, and in which the seat is elongate in shape such that a user can position themselves a desired distance from the hand grips.

10. A muscle exercise device as claimed in claim 9 in which two independent weight stacks are provided, one underneath each winch drum.

* * * * *